United States Patent [19]

Goto

[11] Patent Number: 4,648,702

[45] Date of Patent: Mar. 10, 1987

[54] TONER DENSITY DETECTOR AND TONER SUPPLIER

[75] Inventor: Masahiro Goto, Yokohama, Japan

[73] Assignee: Canon Kabushiki Kaisha, Tokyo, Japan

[21] Appl. No.: 543,930

[22] Filed: Oct. 20, 1983

[30] Foreign Application Priority Data

Oct. 27, 1982 [JP] Japan ..... 57-187360
Oct. 27, 1982 [JP] Japan ..... 57-187361
Oct. 27, 1982 [JP] Japan ..... 57-187362

[51] Int. Cl.[4] ..... G03G 15/00

[52] U.S. Cl. ..... 355/3 DD; 355/14 D; 118/691

[58] Field of Search ..... 355/3 DD, 14 D; 118/688-691, 694; 430/120, 122; 222/DIG. 1; 361/235, 58, 225

[56] References Cited

U.S. PATENT DOCUMENTS 3,234,432 2/1966 Streib ..... 361/235 X
3,554,161 1/1971 Blanchette ..... 361/225 X
4,343,548 8/1982 Bares et al. ..... 355/14 D X
4,383,752 5/1983 Kisler ..... 361/235 X
4,419,960 12/1983 Okamura et al. ..... 118/691 X
4,431,300 2/1984 Snelling ..... 355/14 D
4,462,680 7/1984 Ikeda ..... 355/3 DD X
4,466,732 8/1984 Folkins ..... 355/14 D

OTHER PUBLICATIONS

Automatic High and Low Limit Toner Dispenser Control-Tolliver, Xerox Disclosure Journal, vol. 5, No. 6, Nov./Dec. 1980.

*Primary Examiner*—Arthur T. Grimley
*Assistant Examiner*—C. Romano
*Attorney, Agent, or Firm*—Fitzpatrick, Cella, Harper & Scinto

[57] ABSTRACT

A toner density detecting device has NESA glass, a bias voltage source, a resistor and/or a varistor or Zener diode, and a luminosity detecting circuit which detects the density of toner adhering to the NESA glass using a light source and a photodiode as a light receiving element. The resistor permits detection at a high voltage without causing breakdown while the provision of the varistor in parallel with the resistor permits the application of constant voltage to the NESA glass. In addition a toner supply device has a detector and a toner supply circuit which compares the detection signal from the detector with two reference signals included therein to supply either a constant amount of toner or supply the toner for a predetermined period of time.

14 Claims, 12 Drawing Figures

TONER DENSITY DETECTOR AND TONER SUPPLIER

BACKGROUND OF THE INVENTION

1. Field of the Invention

The present invention relates to a toner density detecting device for detecting the density of a toner and a toner supply device for supplying the toner for use in electronic photographic device and the like.

2. Description of the Prior Art

In general, an electronic photographic device utilizes a two-component developer consisting of a mixture of toner and carrier. It is well known that the weight mixing ratio of the toner to the carrier in the developer is an extremely important factor in order to improve the developing efficiency. If the weight ratio of the toner to the developer (hereinafter referred to as the toner density) is low, that is, if the density of the developer is reduced, the density of a resultant image will become thin on the other hand, if the toner density is too high, such inconveniences will occur that the density of the resultant image become too thick and fog is produced. Therefore, the continuous developing of images of desired tone quality requires adequate control of the toner density and keep the thus controlled density constant.

Conventionally, two techniques for optically measuring the toner density have been known.

In a first technique, a toner density detecting area is provided on a light sensitive drum and a toner is caused to adhere to the drum, thereby measuring the reflected ray indicative of the toner density (reflected density). However, this method has such drawbacks as follows:

(1) Since the toner density detecting area must be provided on the light sensitive drum, the operating sequence is complicated.

(2) Since the light receiving element and light source for use in detection tend to become stained with splashed toner, a separate cleaning device is needed.

(3) The detection level becomes unstable due to variations in latent image potential occurring on the light sensitive drum.

In a second technique, a bias voltage is directly applied to a conductive member and the toner is caused to adhere to the conductive member, thereby measuring the reflected or transmitted ray indicative of the toner density. However, this method also suffers from such problems as follows:

(1) As the above-mentioned bias voltage is increased, breakdown occurs in the developer at a relatively low voltage. Therefore, the density must be measured at a low bias voltage, so that an accurate and stable density measurement is impossible, owing to the fact that since the density of the developer does not reach a saturated state at a low, bias voltage in its V(voltage) - D(density) characteristic, the valve of density is drastically varied with a slight variation in bias voltage. That is, the curve of the above-mentioned V - D characteristic is so steep that the density at a specific bias voltage can not be accurately detected.

(2) If the density is measured in an unsaturated area in the V - D characteristic, a highly accurate bias voltage source is needed and hence the measurement involves great expense.

In addition, as another toner density measuring method, a method of measuring the toner density utilizing a difference in physical property between the toner and the carrier, such as a difference in magnetic permeability, spectrum reflection characteristic, electric conductivity, flow resistance, dielectric constant and the like, is known.

However, all of the above-mentioned methods have circumstance-depending characteristics. In particular, when the brush resistance of a developer is lowered at a high humidity, the developer exhibits a property quite different from that observed at normal humidity, so that the detection level of the toner density is changed and hence a great amount of toner is continuously supplied, which inconveniently causes an excess in toner density and a foggy white background.

SUMMARY OF THE INVENTION

An object of the present invention is to eliminate the above-mentioned drawbacks associated with the conventional techniques.

Another object of the present invention is to provide a toner density detecting device of a simple structure and capable of performing a stable and accurate toner density measurement.

Still another object of the present invention is to provide a toner density detecting device capable of performing the stable and accurate toner density measurement with the simple structure even under highly humid circumstances.

A further object of the present invention is to provide a toner supply device capable of performing an accurate toner supply with a simple structure.

Still a further object of the present invention is to provide a toner supply device capable of performing a stable toner supply even when the environmental conditions are changed.

The other objects of the present invention will be apparent from the following detailed description taken in conjunction of the accompanying drawings and the appended claims.

DETAILED DESCRIPTION OF THE PREFERRED EMBODIMENT

The present invention will be described in detail hereinbelow with reference to the accompanying drawings.

Figure 1:
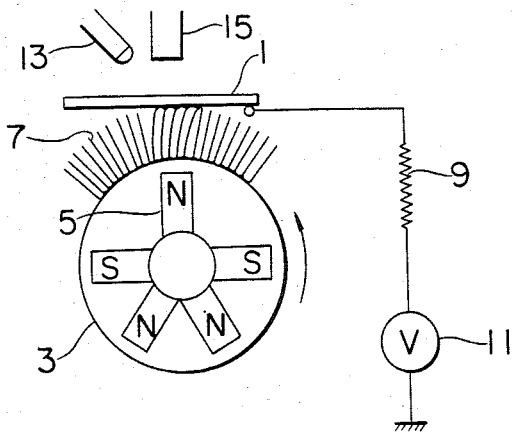
FIG. 1 shows an exemplary arrangement of the toner density detecting device to which the present invention is applied.

FIG. 1 shows an exemplary arrangement of the toner density detecting device to which the present invention is applied, in which 1 is a transparent electrode using, for example, a transparent conductive glass (hereinafter referred to as the NESA glass), 3 is a developing sleeve of a non-magnetic element rotating in the arrow direction, 5 is a magnetic electrode fixedly mounted in the developing sleeve 3, and 7 is a brushed developer produced under the action of a magnetic line of force which is generated from the fixed magnetic electrode 5 when the developing sleeve 3 rotates in the arrow direction. The developer is a two-component developer consisting of a non-magnetic insulating toner ($-10^{15}\Omega$ cm) and a magnetic carrier ($-10^{7}$ to $10^{8}\ \Omega$ cm) of a 250–400 mesh screen of iron with an oxidation film, 9 is a resistor having a high resistance value, for example, on the order of 10 to 30 megohms, 11 is a bias voltage source adapted to apply a predetermined bias voltage to the NESA glass 1 through the resistor 9, 13 is a light source used to measure the reflected density of the toner adhering to the NESA glass 1, 15 is a light receiving element, such as a photodiode, adapted to measure the reflected toner density on receipt of light reflected from the NESA glass 1.

As is well know, the height of the brushed developer 7 (hereinafter referred to as the brush) reaches a maximum immediately on the N pole which is fixed in position opposite to the NESA glass 1 and the brush 7 comes into contact with the NESA glass 1 immediately on the N pole. At the time, since the predetermined bias voltage is being applied to the NESA glass 1, the toner adheres to the surface of the glass.

Figure 2A:
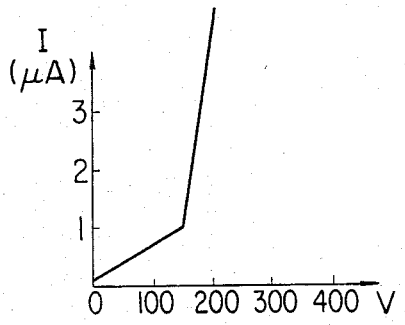
FIGS. 2A and 2B are diagrams respectively showing a change in current through the developer caused by the application of bias voltage.

FIG. 2A shows the voltage-current characteristic obtained immediately after the direct application of the bias voltage from the source 11 to the NESA glass 1. On this occasion, the brush 7 has a resistance value on the order of 100 megohms. As will be apparent from FIG. 2A, when the bias voltage exceeds 150 volts, the breakdown is caused (because the dielectric breakdown occurs in the carrier) and the current is rapidly increased.

Figure 2B:
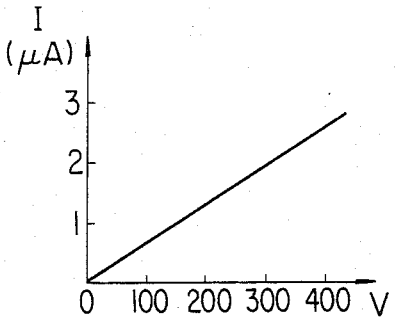

FIG. 2B is a graph plotting the current value obtained immediately after the application of bias voltage through the resistor 9. In this case, unlike FIG. 2A, no breakdown occurs even when the bias voltage is increased to 400 volts because a drastic voltage drop is developed by the resistor 11 having a high resistance value even when a rapid current flows, thereby producing an action to damp out the breakdown.

Figure 3:
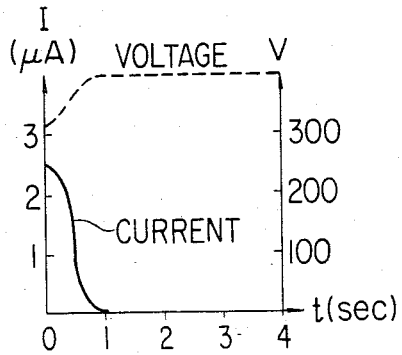
FIG. 3 is a diagram showing current passing through a NESA glass 1 shown in FIG. 1 and voltage applied thereto.

In FIG. 3, the solid line is a graph plotting the time-varying current flowing through the brush 7 when a bias voltage of 400 volts is applied through the resistor 9 and the broken line shows the time-varying voltage applied to the NESA glass 1 at that time. As is apparent from the drawing, the current is gradually decreased immediately after the application of bias voltage and it is almost zero 0.8 seconds later. Therefore, when 0.8 seconds or more pass after the application of voltage, the voltage applied to the NESA glass 1 reaches a constant value of about 400 volts because the highly resistive toner adheres to the NESA glass surface with time to cover the conductive surface of the NESA glass 1 and as a result, the resistance value (about 100 megohms) of the brush 7 is increased substantially as much as 100 to 1,000 times.

Figure 4:
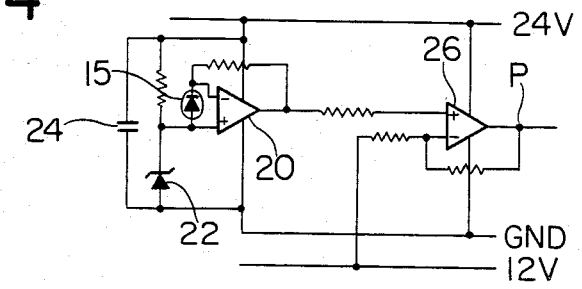
FIG. 4 is a circuit diagram showing an example of a luminosity detecting circuit.

FIG. 4 shows an example of a luminosity detecting circuit which is connected behind the light receiving element 15. In the circuit, 15 is a photodiode acting as the light receiving element, 20 is a current to voltage converter amplifier adapted to amplify the current through the photodiode 15 and convert the amplified current into voltage, 22 is a Zener diode adapted to keep the anode potential of the photodiode 5 constant, 24 is a capacitor connected for noise elimination, and 26 is a voltage amplifier. At an output terminal P of the amplifier 26, a voltage corresponding to the reflected density of the toner is produced. The terminal P is connected to, for example, a toner supply device which will be described later.

It should be noted that the circuit shown in the drawing simply represents a well known circuit and the use of any other similar circuit has no adverse effect on the present invention.

Figure 5:
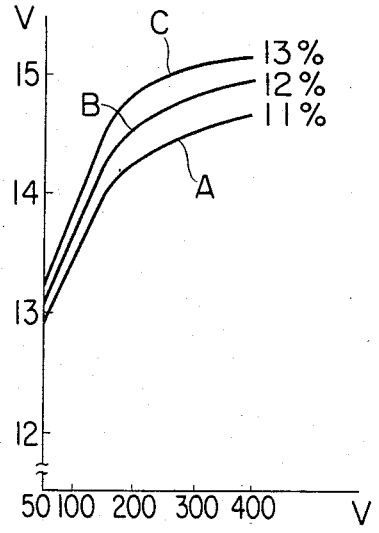
FIG. 5 is a diagram illustrating the operation of the circuit shown in FIG. 4.

FIG. 5 is a graph plotting the change of potential which is observed at the point P when the bias voltage is varied. The bias voltage and the voltage at the point P are chosen as the abscissa and ordinate respectively. The graph reveals the fact that the more the amount of adhering toner, the greater the detected output, when a color toner is used and its density is measured in accordance with the quantity of light reflected thereform. Curve A represents the characteristic obtained when the toner density is 11% and curves B and C also represent the characteristics for the 12% and 13% respectively.

As is apparent from FIG. 5, (1) The curves are so steep when the bias voltage is less than 150 volts that the measured value of the reflected density is drastically varied with a slight change in bias voltage, which means that a stable measurement is impossible at a bias voltage less than 150 volts.

(2) Likewise, the curves are so close to one another at a less than 150-volt bias voltage that the potential at the point P (see FIG. 4) is only varied by a trace amount with a change in toner density and hence it is difficult to find out a change in toner density.

(3) On the other hand, the curves are so gentle and the spacing between adjacent curves is so wide in areas of a 300- to 400-volt bias voltage that the change in toner density can be adequately detected in these areas. That is, as has been described above with reference to FIG. 2B, with the provision of the resistor 9, no breakdown occurs even when the bias voltage is more than 150 volts and hence the density detection in the above-mentioned areas is possible.

Next, the present invention will be described with reference to another embodiment thereof.

Figure 6:
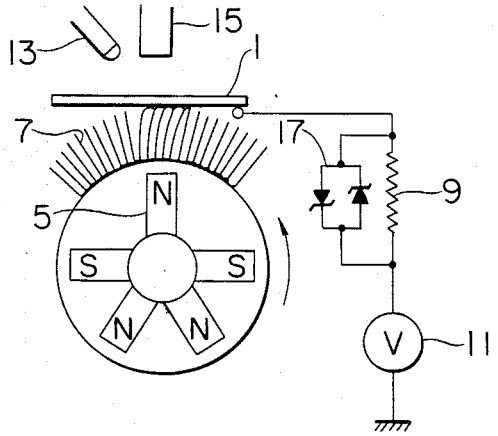
FIG. 6 shows another exemplary arrangement of the toner density detecting device.

FIG. 6 shows another exemplary arrangement of the toner density detecting device. The structure shown in FIG. 6 is different from that shown in FIG. 1 in that the voltage regulation element (varistor) 17 is connected in parallel with the resistor 9. The remainder is the same as that in FIG. 1, so that the description thereof is omitted here.

Figure 7:
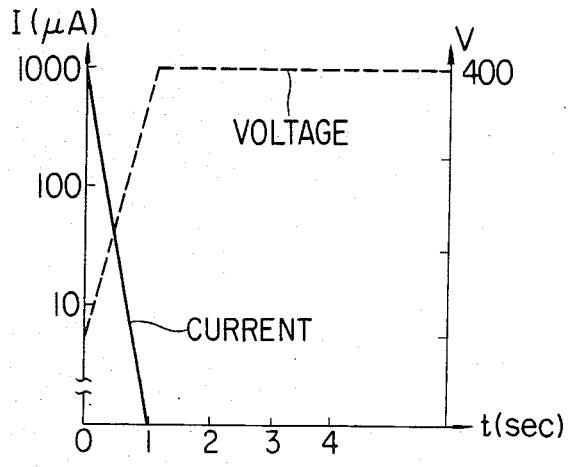
FIG. 7 is a diagram illustrating the operation of a varistor 17 at high humidity.

FIG. 7 is a graph plotting the time-varying current through the brush 7 when a bias voltage of 400 volts is applied through the parallel-connected resistor 9 and varistor 17. The broken line represents the time-varying voltage which is applied to the NESA glass at that time.

In general, since the surface resistance of the carrier included in the developer is reduced with increasing humidity, the resistance of the brush 7 is lowered to on the order of 100 K ohms, that is, the resistance value of the brush 7 is greatly decreased. Thus almost all voltage drops are developed across the resistor 9 and the voltage applied to the NESA glass 1 is reduced to about zero. As a result, the toner can not adhere to the NESA glass 1.

To the contrary, in case that the varistor 17 and the resistor 9 are connected in parallel relationship as shown in FIG. 6, the voltage across the terminals of the resistor 9 is governed by the rated voltage on the varistor 17, so that the voltage is lower than that obtained when only the resistor 9 is connected and hence a constant voltage is applied to the NESA glass 1. For example, if the bias voltage is 400 volts and the rated voltage on the varistor 17 is 300 volts, the voltage across the terminals of the resistor 9 will be 300 volts and a 100-volt voltage will be applied to the NESA glass 1. That is, although the 100-volt voltage is applied to the developer, no breakdown occurs (see FIG. 2A) and the toner begins to adhere to the NESA glass 1. Thus, the apparent resistance of the brush 7 is gradually increased to the value (about 100 megohms) which is almost the same as that obtained at the normal humidity. Then, as is apparent from FIG. 7, when about one second passes after the application of voltage, a voltage of about 400 volts is applied to the NESA glass 1 to permit the stable and accurate measurement of toner density.

Here, assuming that the applied voltage is designated by V and the breakdown voltage of the developer is designated by $V_B$, the varistor 17 will have to have a rated voltage of more than $(V-V_B)$ volts.

At the normal humidity, the resistance of the brush 7 is sufficiently high, so that the voltage across the terminals of the resistor 9 is not raised enough to cause a current to flow through the varistor 17. That is, the varistor 17 has no adverse effect on the toner density measurement.

Although, in the embodiment shown in FIG. 6 the varistor 17 is used as the constant voltage element, any other constant voltage element such as a Zener diode may be alternatively used. However, when the Zener diode is used, it is necessary to reverse its connecting direction in accordance with the polarity of the potential applied from the source 11.

Figure 8:
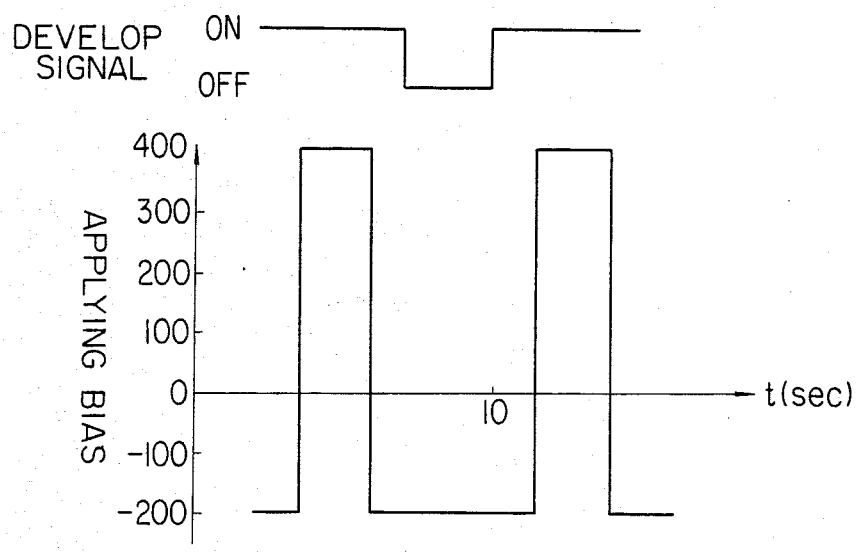
FIG. 8 is a timing diagram showing the sequence of density detection according to an embodiment of the present invention.

FIG. 8 illustrates the execution sequence of the toner density detecting device according to the present invention, that is, a timing diagram indicating how to change the bias voltage in response to a develop signal.

In the following sequence, it is assumed that the developing sleeve 3 is rotated.

(1) With the develop signal ON, at first the −200 volts voltage is applied to the NESA glass 1. Then, since a voltage of the same polarity as that of the toner which has been already charged is applied to the NESA glass 1, the toner becomes apt to fall from the surface of the NESA glass 1. Moreover, since the NESA glass 1 is in contact with a brush 7 portion of the highest density, the cleaning is performed in a short period of time.

(2) Next, the bias voltage is raised to +400 volts by which the toner adheres to the surface of the NESA glass.

(3) The reflected density of the toner is measured using the light source 13 and the light receiving element 15 (see FIG. 1) to determine the amount of toner to be supplied.

(4) The bias voltage is returned to −200 volts to clean the NESA glass 1.

In this connection, in case that the toner density detecting device according to the present invention is incorporated into an electronic photograph device, the toner density can be measured in a position which is equivalent to the develop position of an image carrying element by making the length of the developing sleeve 3 in the axial direction longer than an image area and providing the NESA glass 1, the light source 13 and the light receiving element 15 in positions around a non-image area which is formed adjacent to said image area and opposite to a fixed magnetic pole (developing pole) in the developing sleeve, so that such an advantage that the amount of toner adhering to the NESA glass surface corresponds to the actual density of a developed image is provided. In addition, since the cleaning of the surface of the NESA glass can be readily performed as has been mentioned above, the time required for the toner density measurement can be advantageously shortened.

However, the brush resistance of the developer is reduced from 100 megohms to 100 kiloohms under the highly humid condition as has been mentioned above, so that the resistance of the entire detecting system shown in FIG. 1 is governed by the resistance value (10 to 30 megohms) of the resistor 9 and the bias voltage of the NESA glass surface is reduced to about zero volt due to the resistor drop. Consequently, the toner hardly adheres to the NESA glass surface and as is apparent from FIG. 5, the output detected at the point P in FIG. 4 becomes extremely low.

In the toner supply device according to this embodiment, an internal reference signal is provided in a supply circuit system separately from the standard density signal utilizing the fact that the detected output becomes extremely low when the brush resistance of the developer is reduced at the high humidity to permit the automatic supply of a given amount of toner when the detection signal level is lower than the internal reference signal level.

Figure 9:
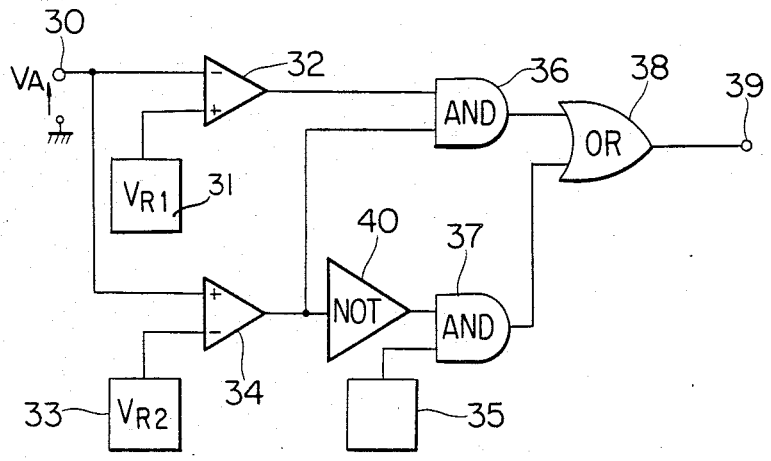
FIG. 9 shows an exemplary circuit arrangement of the toner supply device according to the present invention.

FIG. 9 shows an exemplary circuit arrangement of the toner supply device according to the present invention. In the drawing, 30 is a terminal for introducing a density detection signal $V_A$ which is sent from the point P in FIG. 4, and 31 is a circuit adapted to generate a standard density signal $V_{R1}$. A first comparator 32 compares the levels of the standard density signal $V_{R1}$ and the detection signal $V_A$ to generate the logic signal "1" when $V_A<V_{R1}$ or generate the logic signal "0" when $V_A>V_{R1}$. A second comparator 34 compares the levels of an internal reference signal $V_{R2}$ which is generated from a separately provided internal reference signal generator 33 and the detection signal $V_A$ to generate the logic signal "1" when $V_A>V_{R2}$ or generate the logic signal "0" when $V_A>V_{R2}$. The logic signals generated from the first and second comparators are inputted into an AND circuit 36 which, in turn, outputs "1" only when both the logic signals are "1". The output from the second comparator 34 is also sent to an AND circuit 37 through a NOT circuit 40. 35 is a toner supply signal generator which generates the logic signal "1" only for a given period of time $T_o$ and is constituted, for example, by a timer and the like. The output signals from the AND circuits 36 and 37 are input into an OR circuit 38 and the toner supply operation is performed when the output of the OR circuit 38 is at "1".

The operation of the device shown in FIG. 9 will be described with reference to FIGS. 10 and 11. When the detection signal $V_A$ is larger than the internal reference signal $V_{R2}$, that is, $V_{R2}<V_A$, the output of the second comparator 34 goes to "1". Thus, the output of the AND circuit 37 goes to "0" and the OR circuit 38 outputs a signal which remains at the same level as that of the first comparator output. Accordingly, when the detection signal $V_A$ is larger than the standard density signal $V_{R1}$, it is judged that the toner density is in excess of the standard level and the output of the first comparator 32 goes to "0", so that no toner is supplied. On the other hand, when the detection signal $V_A$ is smaller than the standard density signal $V_{R1}$, it is judged that the toner density is below the standard level and the output of the first comparator 32 goes to "1", so that the toner is supplied.

Figure 10:
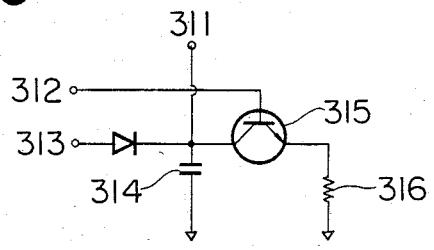
FIG. 10 is a circuit diagram of a reference density signal generator shown in FIG. 9.
Figure 11:
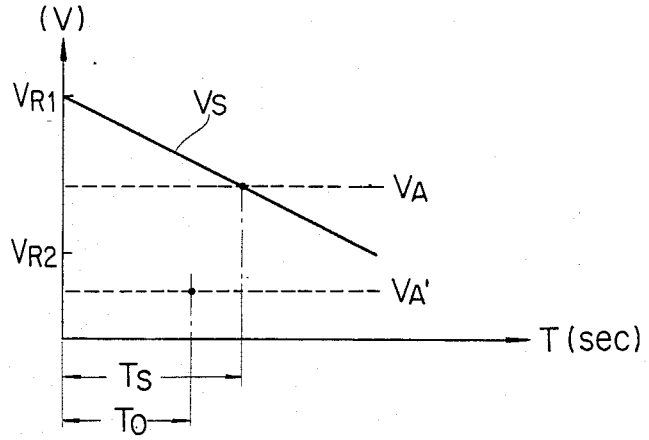
FIG. 11 is a diagram illustrating the operation of the generator shown in FIG. 9.

The standard density signal generator 31 is of a structure as shown in FIG. 10 in which 311 is a terminal which is connected to the first comparator 32, 312 is a terminal through which is inputted an external signal for on/off operation of a transistor 315, and 313 is a terminal for providing the standard density signal level voltage $V_{R1}$. These terminals operate in synchronism with the timing of the bias voltage application shown in FIG. 8, that is, when the +400 volts bias voltage is applied, a 5-volt signal is input to the terminal 312 and the terminal 313 falls to the GND level, while when the −200 volts bias voltage is applied, the terminal 312 falls to the GND level and the standard density signal $V_{R1}$ which has been previously set is input into the terminal 313. Accordingly, the signal supplied to the first comparator 32 is lowered on a given slope with time as shown by the solid line $V_S$ in FIG. 11 once the +400 volts bias voltage is applied to the NESA glass. Therefore, the time $T_S$ during which the toner is being supplied is determined in accordance with a difference between the detection signal $V_A$ and the standard density signal $V_{R1}$ and the toner is continuously supplied until the line $V_S$ intersects with the line $V_A$.

On the other hand, when the detection signal $V_A$ is smaller than the internal reference signal $V_{R2}$, the output of the second comparator 34 goes to "0" and the output of the AND circuit 36 also goes to "0". Then, the logic "1" is into one terminal of the AND circuit 37 through the NOT circuit 40 and thus the OR circuit 38 generates the output signal of the toner supply signal generator 35 as it is. Since the toner supply signal generator 35 generates the logic signal "1" for the predetermined period of time $T_o$, the toner is supplied only for the time $T_o$ and thereafter, even when the detection signal level is lowered to $V'_A$, the toner is not supplied until the line $V'_A$ intersects with the line $V_S$ as shown in FIG. 11. In this manner, when the detection signal $V_A$ is larger than the internal reference signal $V_{R2}$, the toner supply time is determined in accordance with the difference between the detection signal $V_A$ and the standard density signal $V_{R1}$, while when the detection signal is smaller than the internal reference signal $V_{R2}$, the mode is preferentially switched to constant supply regardless of the difference between the detection signal $V_A$ and the standard density signal $V_{R1}$.

Consequently, under normal humid circumstances, the toner supply is conducted in accordance with the detected level of the toner density, while at high humidity, it is automatically switched to the constant supply when the brush resistance of the developer is lowered to fractions (less than 1/10 to 1/100) of its normal value.

Although the above-mentioned description has reference to the case in which color toner is used and the detected output is increased with increasing the amount of toner adhering to the NESA glass, it is apparent that it is also applicable to the case in which a black toner is used and the detected output is decreased with increasing the amount of toner adhering to the surface glass, simply by reversing the order of generation of the indivisual signal levels.

As has been mentioned above, according to the present invention, since the breakdown of the developer can be restrained even when a high voltage is applied to the NESA glass, there can be provided the toner density detecting device ensuring stable and accurate measurement of the toner density.

In addition, according to the present invention, since the voltage applied to the NESA glass can be kept at a constant level to permit the toner to adhere to the glass even when the resistance value of the developer is reduced with increasing humidity, there can be provided the toner detecting device ensuring stable and accurate measurement of the toner density.

Further, according to the present invention, since there is no need to detect the difference in spectrum reflectivity between the carrier and the toner, there can be provided a toner density detecting device which can handle any kind of developer. That is, the present invention has such an advantage that it is applicable to color copiers, as well as to black/white copiers.

Moreover, according to the present invention, since the automatic switching to the toner supply of constant amount at the high humidity and the automatic supply of toner of the amount proportional to the toner density at the normal humidity are possible, there can be provided a toner supply device free from a specific sensor and the like and having a simple structure. Further, since the present invention can be applied to the toner supply of any kind of developer, it can be used as the toner supply device in both of the color and black/-white copiers.

Although the present invention has been described with reference to its preferred embodiments, the present invention is not limited thereto and various changes and modifications can be made without departing from the scope of the claims.

What I claim is:

1. A toner density detecting device comprising:

means for detecting a toner density of a developer, said means including a conductive member for receiving a toner for density detection;

applying means for applying a bias voltage to said conductive member; and resistor means provided between said conductive member and said applying means to suppress excessive current flow through said conductive member during toner density detection, said excessive current flow being caused by a breakdown of the developer.

2. The device according to claim 1, wherein said conductive member is a transparent electrode.

3. The device according to claim 2, wherein said detecting means further includes a circuit for measuring the density of the toner adhering to said transparent electrode with the use of a light source and a light receiving element.

4. The device acccording to claim 1, wherein said conductive member is provided in a posiiton around a developing sleeve for forming a visible image on a surface, said position being a non-imaging area adjacent to an imaging area.

5. The device according to claim 4, wherein said conductive member is also provided in opposition to a magnetic pole which is fixedly provided within said developing sleeve.

6. A toner density detecting device comprising:

means for detecting a toner density of a developer, said means including a conductive means for receiving a toner for density detection;

applying means for applying a bias voltage to said conductive member;

resistor means arranged to suppress excessive current flow through said conductive member during toner density detection, said resistor being connected between said conductive member and said applying means; and a voltage regulation element connected parallel to said resistor means to apply a predetermined voltage level to said conductive member during toner density detection, said voltage level being predetermined so as not to cause a breakdown of said developer.

7. The device according to claim 6, wherein said voltage regulating element comprises a varistor or a Zener diode.

8. The device according to claim 6, wherein said conductive member is a transparent electrode.

9. The device of claim 8, wherein said detecting means further includes a circuit for measuring the density of the toner adhering to said transparent electrode with the use of a light source and light receiving element.

10. The device according to claim 6, wherein said conductive member is provided in a position around a developing sleeve for forming a visible image on a surface, said position being a non-imaging area adjacent to an imaging area.

11. The device according to claim 10, wherein said conductive member is provided in opposition to a magnetic pole which is fixedly provided within said developing sleeve.

12. A toner supply device comprising:

detector means adapted to detect a density of a toner;

reference signal generating means adapted to generate a first reference level signal; and supplying means for changing toner supplying modes in accordance with a detection level output from said detector means, said supplying means having a first mode for supplying a toner in accordance with said detection level when said detection level is higher than said first reference level and a second mode for supplying a predetermined amount of toner less than an amount of toner corresponding to said detection level when said detection level is lower than said first reference level.

13. The device according to claim 12, wherein said reference signal generating means generates a second reference level signal and said supplying means supplying the toner in accordance with said detection level when said detection level is between said first and second levels.

14. The device according to claim 12, wherein said detector means includes a light source, a light receiving element, and a transparent electrode and measures the density of the toner adhering to said transparent electrode with the use of said light source and said light receiving element.

* * * * *

UNITED STATES PATENT AND TRADEMARK OFFICE
CERTIFICATE OF CORRECTION

PATENT NO. : 4,648,702

DATED : March 10, 1987

INVENTOR(S) : MASAHIRO GOTO

It is certified that error appears in the above-identified patent and that said Letters Patent is hereby corrected as shown below:

AT [57] IN THE ABSTRACT

Line 9, "In addition" should read --In addition,--.

COLUMN 1

Line 21, "thin on" should read --thin. On--.
Line 23, "become" should read --becomes--.
Line 26, "keep the thus controlled" should read --keeps the thus-controlled--.
Line 56, "valve" should read --value--.

COLUMN 2

Line 39, "DRAWING" should read --DRAWINGS--.

COLUMN 3

Line 2, "EMBODIMENT" should read --EMBODIMENTS--.
line 30, "know," should read --known,--.

COLUMN 4

Line 10, "photodiode 5" should read --photodiode 15--.
Line 28, "thereform." should read --therefrom.--.

UNITED STATES PATENT AND TRADEMARK OFFICE

CERTIFICATE OF CORRECTION

PATENT NO. : 4,648,702

DATED : March 10, 1987

INVENTOR(S) : MASAHIRO GOTO

It is certified that error appears in the above-identified patent and that said Letters Patent is hereby corrected as shown below:

COLUMN 6

Line 3, "photograph" should read --photographic--.
Line 53, "$V_A > V_{R2}$." should read --$V_A < V_{R2}$.--

COLUMN 7

Line 41, "is into" should read --is input into--.

COLUMN 8

Line 5, "divisual" should read --dividual--.
Line 62, "acccording" should read --according--.
Line 63, posiiton" should read --position--.

COLUMN 9

Line 21, "regulating" should read --regulation--.
Line 25, "of claim" should read --according to claim--.

UNITED STATES PATENT AND TRADEMARK OFFICE

CERTIFICATE OF CORRECTION

PATENT NO. : 4,648,702

DATED : March 10, 1987

INVENTOR(S) : MASAHIRO GOTO

It is certified that error appears in the above-identified patent and that said Letters Patent is hereby corrected as shown below:

COLUMN 10

Lines 23-24, "supplying" should read --supplies--.

Signed and Sealed this

Nineteenth Day of January, 1988

*Attest:*

*Attesting Officer*

DONALD J. QUIGG

*Commissioner of Patents and Trademarks*